United States Patent [19]

Sawazaki et al.

[11] Patent Number: 4,671,083

[45] Date of Patent: Jun. 9, 1987

[54] DRIVING APPARATUS IN TAKE UP UNIT OF CIRCULAR KNITTING MACHINE

[75] Inventors: Masatoshi Sawazaki; Kouji Tsuchiya, both of Hyogo, Japan

[73] Assignee: Precision Fukuhara Works, Ltd., Hyogo, Japan

[21] Appl. No.: 799,972

[22] Filed: Nov. 20, 1985

[30] Foreign Application Priority Data

Jan. 25, 1985 [JP] Japan ..... 60-012828

[51] Int. Cl.[4] ..... D04B 15/88

[52] U.S. Cl. ..... 66/151; 66/153; 474/49

[58] Field of Search ..... 66/149 R, 151, 152, 66/153; 139/308; 474/49

[56] References Cited

U.S. PATENT DOCUMENTS

| | | | |
|---|---|---|---|
| 1,435,176 | 11/1922 | Pecker | 66/152 |
| 2,649,811 | 8/1953 | Noe | 66/149 R X |
| 2,760,362 | 8/1956 | Trumpio | 66/149 R |
| 3,222,889 | 12/1965 | Mishcon | 66/153 X |
| 4,565,076 | 1/1986 | Tsuchiya | 66/151 |

FOREIGN PATENT DOCUMENTS

| | | | |
|---|---|---|---|
| 578384 | 10/1977 | U.S.S.R. | 66/152 |
| 962696 | 9/1982 | U.S.S.R. | 474/49 |

*Primary Examiner*—Wm. Carter Reynolds

*Attorney, Agent, or Firm*—Bell, Seltzer, Park & Gibson

[57] ABSTRACT

The present drive for the fabric take up mechanism includes a pair of drive pulleys and a drive belt interposed in the power transmission drive and between the revolving needle cylinder and the fabric delivery rolls and the fabric take up roll. At least one of the drive pulleys is of the variable or adjustable diameter type including radially adjustable drive segments supported between opposite side pulley flanges. Radial grooves are provided in one pulley flange and spiral grooves are provided in the other pulley flange and operate in response to rotation of one flange relative to the other flange to adjust the diameter of the peripheral drive surface of the pulley. The variable diameter drive pulley is adjustable so that the speed of rotation of the delivery rolls and the fabric take up roll can be coordinated with the speed of production of the knit fabric to maintain substantially uniform tension in the knit fabric.

4 Claims, 7 Drawing Figures

DRIVING APPARATUS IN TAKE UP UNIT OF CIRCULAR KNITTING MACHINE

FIELD OF THE INVENTION

This invention relates generally to an improved drive for the fabric take up mechanism of a circular knitting machine of the type provided with fabric delivery rolls and a take up roll supported to synchronously revolve with the needle cylinder, and more particularly to such an improved drive which may be easily adjusted to vary the fabric take up rate so that substantially uniform tension is maintained on a wide variety of different kinds and styles of tubular knit fabric as it is withdrawn from the knitting machine and wound onto the take up roll.

BACKGROUND OF THE INVENTION

It is generally known to withdraw circular fabric from a circular knitting machine through delivery rolls positioned below the needle cylinder to flatten the same and then wind the flattened fabric onto a take up roll supported beneath the delivery rolls. The delivery rolls and the take up roll are supported in a frame which revolves with the needle cylinder. The revolving frame imparts rotation to a power transmission mechanism to impart rotation to the delivery rolls and the fabric take up roll. Various types of power transmission mechanisms have been proposed for imparting the proper speed of rotation to the delivery rolls and the fabric take up roll so that the fabric remains under tension as it passes through the delivery rolls and is wound on the take up roll.

The rotational speed of the delivery rolls is normally adjusted to be sufficient to maintain the fabric under tension when the knitting machine is set up to knit the maximum length of fabric. However, if the length of fabric being knitted is varied from this maximum length, because of different stitch construction, different types of yarn, or variation in the stitch length being formed, tension in the fabric will gradually increase during knitting to the point that the fabric is torn or knitting needles are placed under sufficient stress that breakage occurs. One proposed solution to such increased tension is to provide a detector to stop the knitting machine when the tension in the fabric increases above a predetermined amount. This stoppage of the machine requires attention by the machine operator to correct the problem and increases the cost of knitting the fabric.

Also, it has been proposed to support the delivery rolls on pivoted brackets so that the delivery rolls are raised by the fabric as the tension in the fabric increases. In this type of fabric take up, the power transmission mechanism includes fixed diameter drive pulleys connected by a drive belt and the upward movement of the delivery rolls decreases the distance between the drive pulleys so that the belt slips and rotation of the delivery rolls is temporarily stopped to reduce tension in the knit fabric. As the tension in the fabric reduces, the distance between the pulleys is gradually lengthened and the belt is tightened so that the delivery rolls are again rotated. With this type of take up mechanism, the tension on the knit fabric is constantly increased and decreased so that variable tension is continuously applied throughout the length of the fabric and this results in objectionable stitch loops of varying lengths in the fabric.

When it is desired to change the speed of the delivery rolls to knit different fabrics, it is necessary to manually change both of the drive pulleys for drive pulleys of different diameter. This is time consuming because the proper size of the drive pulleys is determined by trial and error. Also, this method of controlling the speed of the delivery rolls requires that a large inventory of different diameter drive pulleys be available for use.

It has also been known to utilize variable speed pulleys of the type having inwardly and outwardly adjustable tapered or cone-shaped drive flanges. With this type of drive pulley, the speed of rotation imparted to the delivery rolls and the fabric take up roll by the power transmission mechanism can be varied, relative to the rotational speed of the needle cylinder. In this type of variable speed pulley arrangement, the radial position of the belt contacting the inwardly tapered pulley flanges is varied to match the rotating speed of the take up mechanism with the knitting speed so that the drive pulleys do not have to be manually changed. However, this arrangement does not permit slipping of the belt when an abnormal amount of tension is placed on the knit fabric so that there is danger of the fabric being torn or the needles being broken.

SUMMARY OF THE INVENTION

With the foregoing in mind, it is an object of the present invention to provide an improved drive for the fabric delivery and take up rolls which provides substantially constant and uniform tension on a wide variety of different types of knit fabric so that the fabric has uniform stitch density and is of high quality.

The improved drive of the present invention is easily adjusted to vary the rotational speed of the delivery rolls and the fabric take up rolls so that the fabric is taken up under substantially uniform tension as it is being produced by the knitting machine. The drive is adjustable to vary the rotational speeds of the delivery rolls and the fabric take up roll to correspond to the speed at which the fabric is being knit, regardless of the kind and type of fabric being knit.

The drive of the present invention also provides for slippage of the drive belt should the knit fabric be tensioned to a greater amount than desired. Also, the present drive is adjustable to vary the rotational speed of the delivery rolls and the fabric take up roll relative to the needle cylinder by providing a pair of drive pulleys with radially adjustable independent belt drive segments supported between the two flanges of the pulley. These adjustable belt drive segments define a flat bottomed groove forming a driving peripheral surface which is contacted by the belt and permits slippage of the drive belt when tension in the fabric is increased.

The two opposing flanges of the pulley are rotatable relative to each other to move the independent drive segments outwardly or inwardly and to thereby change the speed of movement of the drive belt in engagement therewith. One of the pulley flanges is provided with radially extending guide grooves with one of the drive segments being supported for radial inward and outward movement in each of the guide grooves. The other of the pulley flanges is provided with spiral grooves on the inner face thereof and the drive segments are provided with guide pins engageable with the spiral grooves so that rotation of this pulley flange selectively imparts inward and outward movement to the drive segments to thereby vary the effective driving diameter of the pulley.

In accordance with the present invention, both of the drive pulleys are provided with the radially adjustable drive segments so that the driving peripheral surface of the pulleys can be selectively increased or decreased. The ability to increase or decrease the driving surface of the pulleys permits the speed of the delivery rolls and the fabric take up roll to be easily and quickly varied to exactly match the speed at which the fabric is being produced by the knitting machine so that it is not necessary to change one size drive pulley for a drive pulley of a different size. Also, the pulley with radially adjustable drive segments permits slippage of the drive belt to avoid damage to the fabric because of excessive tension being placed thereon.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
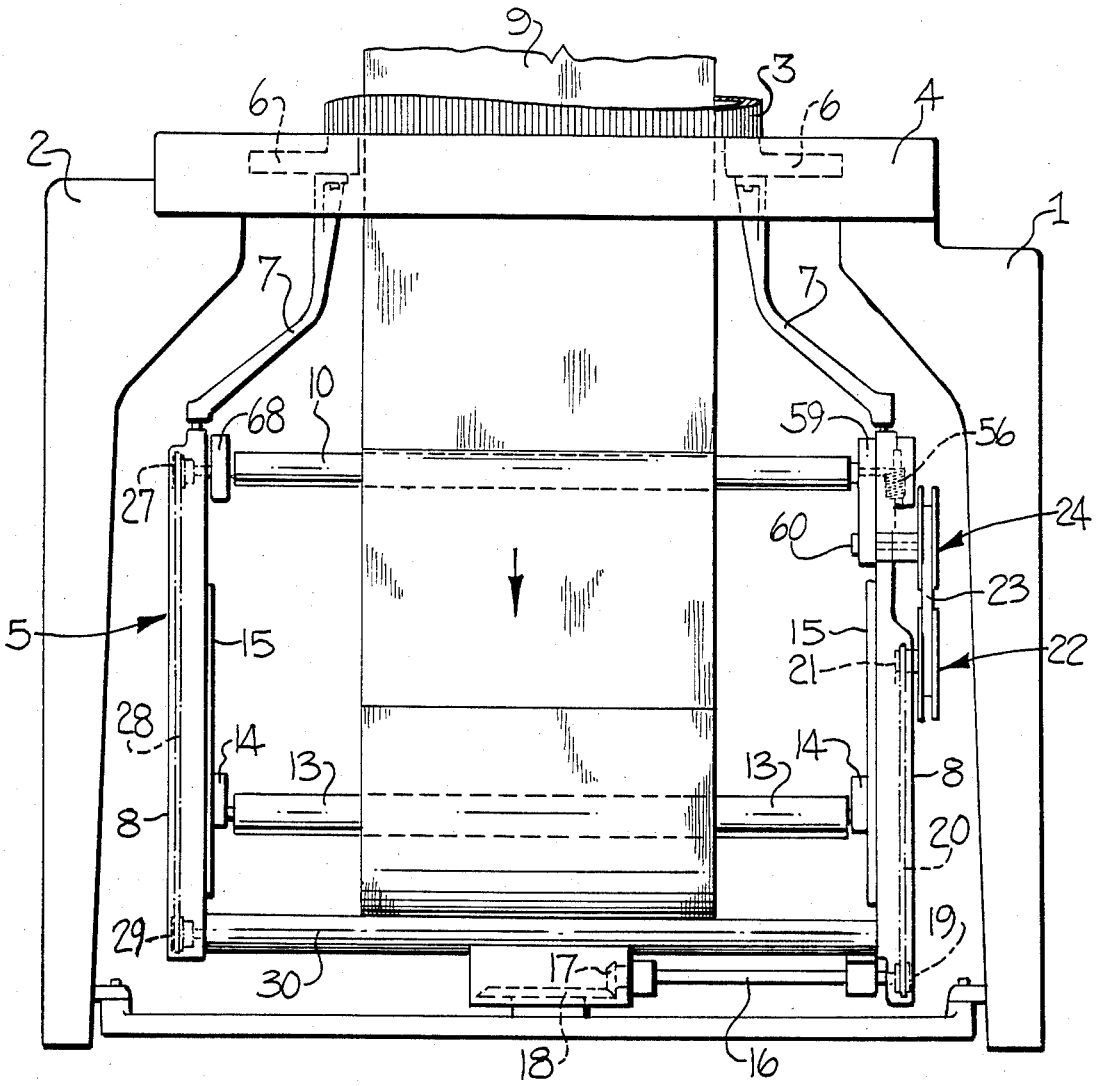
FIG. 1 is a front elevational view of the present take up unit supported below the lower bed of the knitting machine.

As illustrated in FIG. 1, the lower bed 4 of the knitting machine is supported by legs 1, 2 and rotatably supports a ring gear 6 for drivingly rotating a needle cylinder 3. A take up unit, broadly indicated at 5, is supported by brackets 7 for revolving motion on the ring gear 6 and includes support frame means including opposite side frame members 8.

Figure 2:
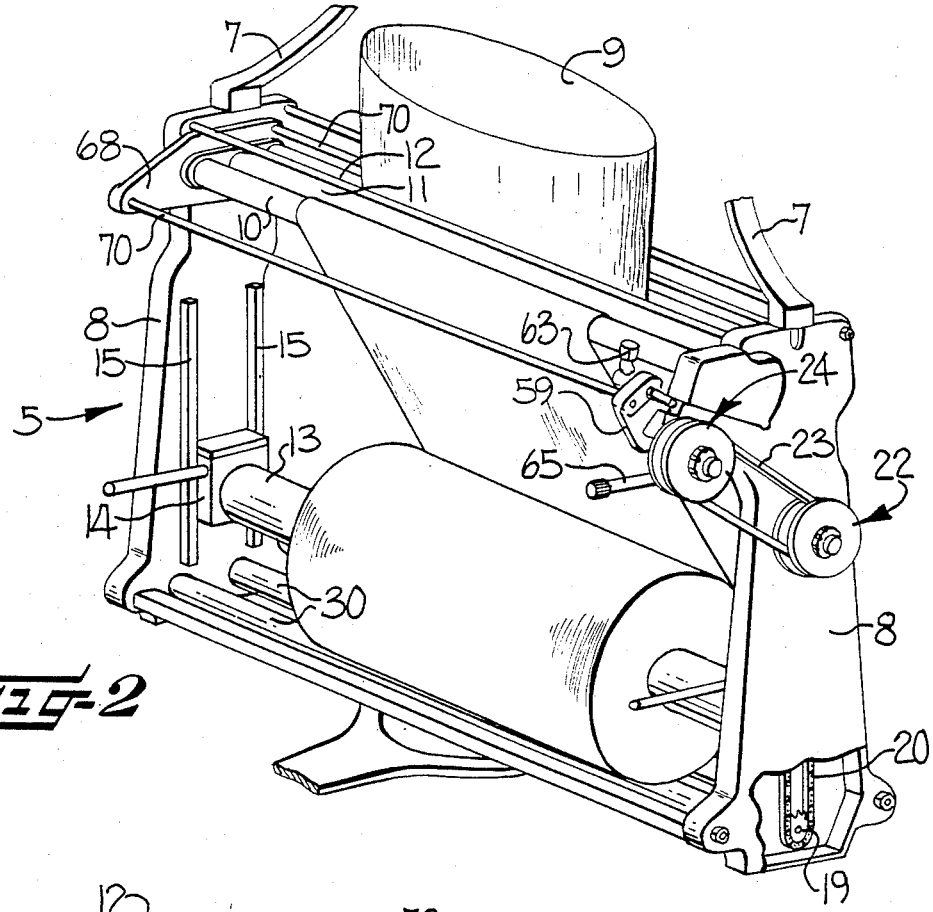
FIG. 2 is a perspective view of the take up unit.

The knit fabric 9 is formed in a seamless tubular manner and directed downwardly from the needle cylinder 3 and flattened as it is directed between delivery rolls 11 and 12, over delivery roll 10, and is wound up on a fabric take up roll 13. As illustrated in FIG. 2, opposite ends of the fabric take up roll 13 are rotatably supported in bearing blocks 14 mounted for vertical sliding movement along vertical slide rails 15 fixed on the inner surfaces of the opposite side frame members 8.

A power transmission mechanism is provided to impart driving rotation to the delivery rolls 10–12 and the fabric take up roll 13 in timed relationship to rotation of the ring gear 6. The power transmission mechanism includes a drive shaft 16 (FIG. 1) which is rotated as the take up unit 5 revolves and imparts driving movement to a small bevel gear 17 fixed on the inner end of the shaft 16 and in driving engagement with a large bevel gear 18 which is fixed on a lower platform fixed between the legs 1, 2.

A sprocket 19 is fixed on the outer end of the drive shaft 16 and a sprocket chain 20 drivingly connects the sprocket 19 to a sprocket 21. The sprocket 21 is drivingly connected to a variable diameter pulley, broadly indicated at 22, to be presently described in detail. A drive belt 23 drivingly connects the pulley 22 with a second pulley, broadly indicated at 24, and is also be of the variable diameter type.

Figure 6:
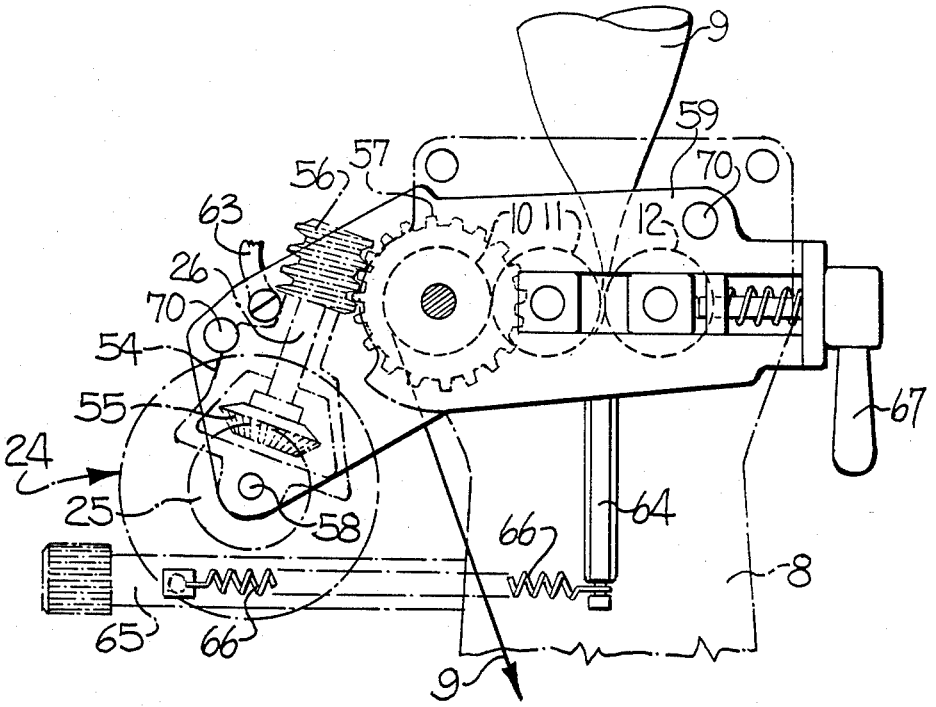
FIG. 6 is a fragmentary elevational view of the upper right-hand end portion of the take up unit, showing the support frame in phantom lines.

A bevel gear 25, shown in dash-dot lines in FIG. 6, is fixed to the inner side of the pulley 24 and is adapted to drive the driven delivery rolls 10-12 in a manner to be presently described. Rotation of the driven delivery roll 10 drives a sprocket wheel 27 (FIG. 1) fixed on the left-hand end of the delivery roll 10. A sprocket chain 28 engages the sprocket 27 and drives a pair of sprockets 29 on the left-hand ends of spaced-apart cradle rolls 30 (FIG. 2) which extend below and support the knit fabric 9 wound onto the take up roll 13. The cradle rolls 30 frictionally engage the outer surface of the fabric 9 on the take up roll 13 to rotate the same in timed relationship to rotation of the ring gear 6 and the needle cylinder 3.

Figure 4:
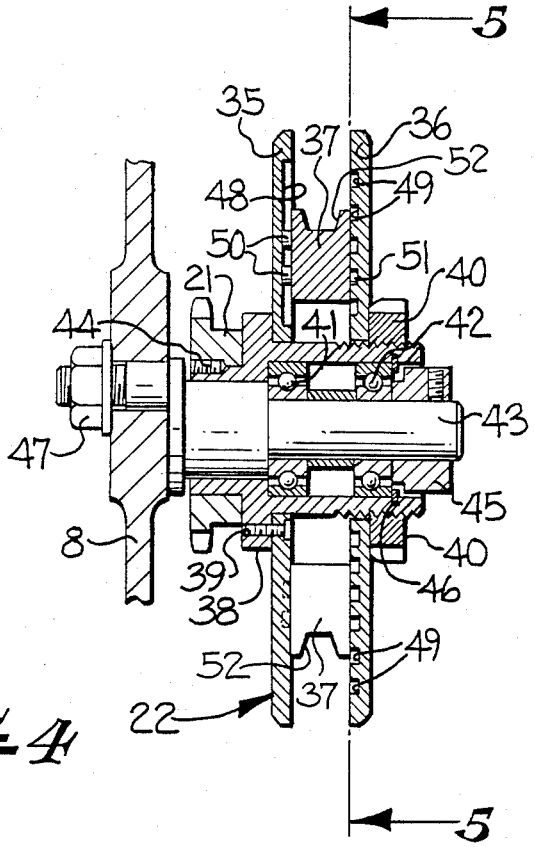
FIG. 4 is an enlarged vertical sectional view through one of the variable diameter drive pulleys, taken substantially along the line 4—4 in FIG. 3.
Figure 5:
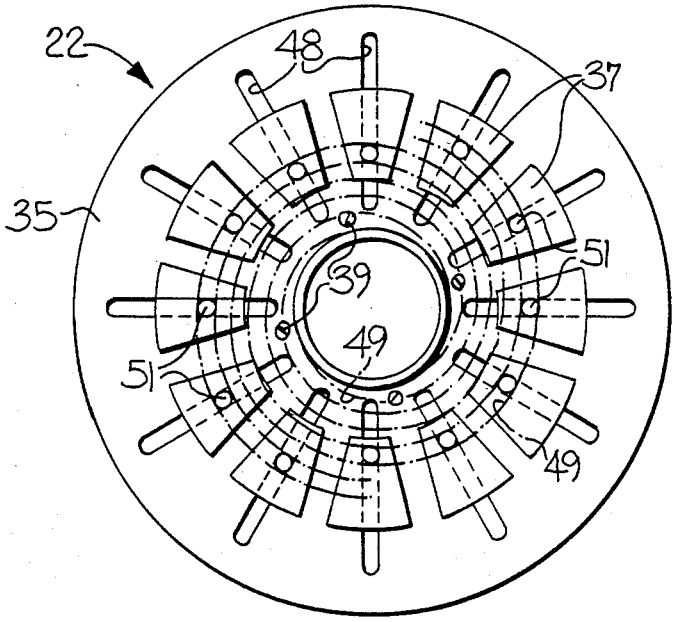
FIG. 5 is a vertical sectional view taken along the line 5—5 in FIG. 4.

The variable diameter pulleys 22, 24 form a portion of the improved drive of the present invention. The details of the variable diameter pulley 22 will be described and, the other pulley 24 is also of the variable diameter type and will be formed in the same manner as the variable diameter pulley 22. As best illustrated in FIGS. 4 and 5, the variable diameter pulley 22 is provided with opposed side flanges 35, 36 with a plurality of wedge-shaped drive segments 37 supported between the flanges 35, 36. The inner flange 35 is fixed to a drive hub 38 by means of a screw 39. A nut 40 is threadably supported on the outer end portion of the hub 38 and maintains the flanges 35, 36 and the drive segments 37 in fixed relationship to each other. An eccentric stub shaft 43 rotatably supports the hub 38 on bearings 41, 42. The sprocket 21 is fixed to the hub 38 by a screw 44 (FIG. 4) and the hub 38 is prevented from axial movement on the stub shaft 43 by an inner shoulder and an outer snap ring 46 and an outer collar 45. The eccentric stub shaft 43 is maintained in adjustable position on the support frame member 8 by means of a nut 47 so that the axial position of the variable diameter pulley 22 and the sprocket 21 can be adjusted.

The inner surface of the flange 35 is provided with radially extending guide grooves 48 and each of the drive segments 37 is provided with a pair of guide members 50 which are supported for radial sliding movement in the grooves 48. The inner surface of the flange 36 is provided with a pair of spiral grooves 49, illustrated in dash-dot lines in FIG. 5, and the corresponding side of each of the drive segments 37 is provided with a guide pin 51 supported for longitudinal sliding movement in the spiral grooves 49, as schematically illustrated in FIG. 5.

To adjust the radial positions of the driving segments 37 inwardly or outwardly, the nut 40 is loosened so that the outer flange 36 may be rotated relative to the inner flange 35. Clockwise rotation of the outer flange 36 causes all of the drive segments 37 to be moved outwardly while counterclockwise rotation of the outer flange 36 causes all of the drive segments 37 to be moved inwardly, thereby varying the driving diameter of the pulley in engagement with the drive belt 23. Thus, adjustment of the driving diameter of the pulley 22 correspondingly increases or decreases the rotational speed of the delivery rolls 10–12 and the fabric take up roll 13 relative to the rotational speed of the ring gear 6. As shown in FIG. 4, the outer surfaces of the drive segments 37 are each provided with a U-shaped groove 52 which is engaged by the drive belt 23.

As has been mentioned, the second pulley 24 is also of the variable diameter type and identical to the variable diameter pulley 22 heretofore described. Since the pulley 24 is also of the variable diameter type, the bevel gear 25 will be attached thereto in the same manner as the sprocket 21 is attached to the inner surface of the variable diameter pulley 22.

In any event, the bevel drive gear 25 is drivingly connected to the delivery roll 10 by means of a gear support housing 54 (FIG. 6) rotatably supporting a bevel gear 55 and a worm 56 on opposite ends of a drive shaft 26. The housing 54 is supported for pivotal movement, as indicated at 58 on the forward end of a pivot bracket 59 by means of a nut 60 (FIG. 1). The pivot bracket 59 is supported for pivotal movement on the shaft of the delivery roll 100 and rotatably supports the pulley 24 in the forward lower end thereof. The pivot bracket 59 also rotatably supports the right-hand ends of the driven delivery rolls 10–12.

Figure 3:
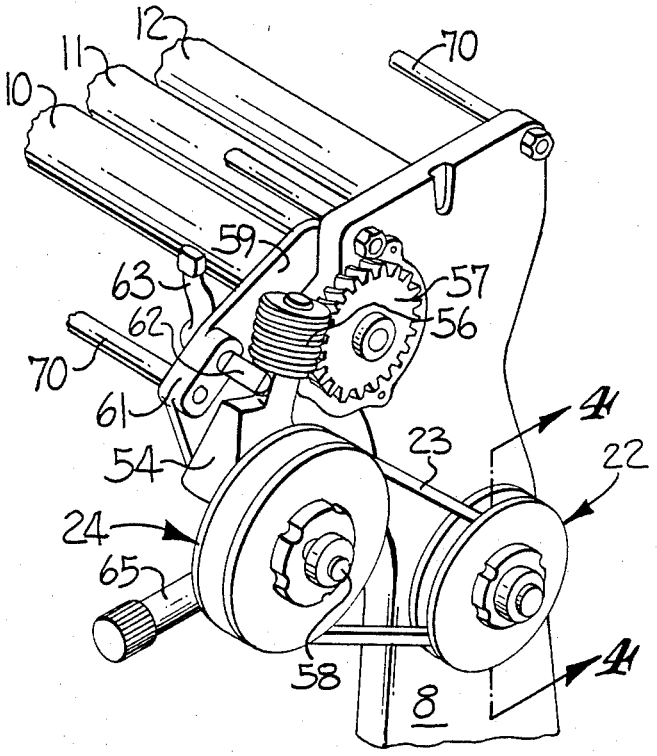
FIG. 3 is an enlarged perspective view of the upper right-hand portion of FIG. 2.

As illustrated in FIG. 3, the upper forward portion of the pivot bracket 59 is provided with an integral bearing boss 61 in which a drive control lever 63 is supported for pivotal movement. A semicircular cam pin 62 extends outwardly from the lower portion of the control lever 63 and engages the gear support housing 54 to control inward and outward movement of the worm 56 into and out of driving engagement with the worm wheel 57.

As illustrated in FIG. 6, a spring perch 64 is fixed at its upper end in the pivot bracket 59 and its lower end supports the rear end of a tension spring 66. The front end of the tension spring 66 is supported on a spring perch fixed to and extending outwardly from a belt tension adjusting control 65. The spring 66 normally urges the pivot bracket 59 to rotate in a clockwise direction, thereby maintaining tension on the drive belt 23 extending between the drive pulleys 22, 24. When an unusually large amount of tension is placed on the fabric 9, extending from the needle cylinder 3 to the delivery rolls 10–12, the delivery rolls 11, 12 are raised upwardly against the action of the spring 66 so that the front portion of the pivot bracket 59 moves downwardly to lower the pulley 24 and move it closer to the pulley 22 so that the belt 23 will slip and interrupt transmission of movement between the two pulleys 22, 24, and the tension on the fabric 9 will thus be reduced. As illustrated in the right-hand portion of FIG. 6, the delivery rolls 11, 12 are supported on slide blocks which are normally urged toward each other by a compression spring, and a control lever 67 is provided for releasing frictional contact between the delivery rolls 10–12.

Figure 7:
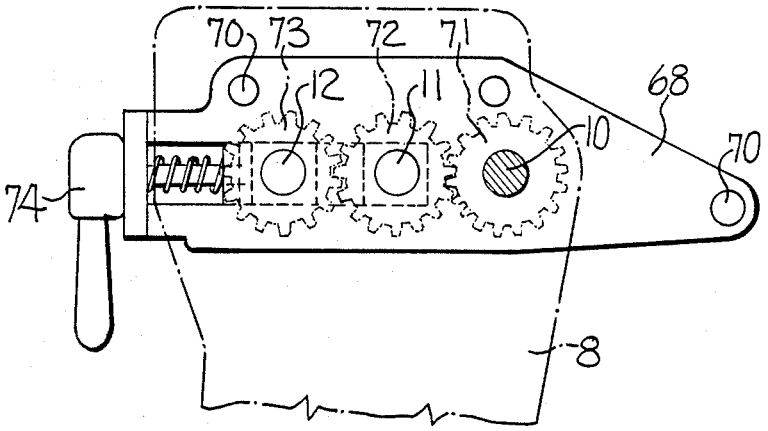
FIG. 7 is a view similar to FIG. 6 but showing the upper end portion of the left-hand end portion of the support frame.

A second pivotal bracket 68 is supported for pivotal movement about the left-hand end portion of the support shaft of the delivery roll 10 (FIG. 7) and is physically connected to the pivot bracket 59 by front and rear connecting tie rods 70. The delivery rolls 10–12 are drivingly interconnected at the left-hand ends thereof by a spur gear 71 fixed on the delivery roll 10, a spur gear 72 fixed on the delivery roll 11, and a spur gear 73 fixed on the delivery roll 12 (FIG. 7). A compression spring normally urges the delivery rolls 10–12 into engagement with each other and the resilient engagement can be temporarily released by rotating a release lever 74.

In accordance with the present invention, variable diameter pulleys, such as pulleys 22, 24, are provided in the power transmission mechanism between the rotating ring gear 6 and the drivingly connected delivery rolls 10–12 and fabric take up roll 13 so that the rotational speed of the delivery rolls 10-12 and the fabric take up roll 13 can be varied relative to the rotating speed and the rate at which knit fabric is produced by the knitting machine. The variation of the rotational take up speed of the fabric, relative to the rate at which the fabric is being produced, is achieved in a simple manner by rotating the outer flange 36 of the variable diameter pulley 22, 24, to adjust the drive segments 37 inwardly or outwardly and thereby increase or decrease the fabric take up speed so as to provide uniform tension in the fabric and to produce high quality fabric. If the adjustment of the variable diameter pulley is not correctly made, any increase in tension above the desired amount in the fabric will automatically lift the delivery rolls 11, 12 and decrease the distance between the pulleys 22, 24 so that the drive belt 23 can slip and thereby prevent tearing of the fabric or breaking of the needles.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a circular knitting machine including a needle cylinder, and a fabric take up mechanism, said fabric take up mechanism including support frame means attached to and extending below said needle cylinder to synchronously revolve therewith, a fabric take up roll supported for rotation on said support frame means, fabric delivery rolls frictionally gripping the knit fabric extending from the needle cylinder and directing the knit fabric onto said fabric take up roll, pivoted support brackets supported on said support frame means and supporting said fabric delivery rolls on one end portion thereof and power transmission means operable in response to revolving movement of said support frame means for imparting rotation to said fabric delivery rolls and said fabric take up roll, the combination therewith of improved drive means interposed in said power transmission means and comprising a pair of spaced-apart drive pulleys rotatable about parallel axes and being positioned in said power transmission mechanism and in advance of said fabric delivery rolls, one of said drive pulleys being rotatably supported on the other end of one of said pivoted support brackets, a driving belt drivingly connecting said spaced-apart pair of drive pulleys, wherein each of said drive pulleys includes an adjustable diameter driving surface engaged by said drive belt for adjustably varying the relative rotational speeds of said drive pulleys relative to each other and to thereby vary the rotational speed of said fabric delivery rolls and said fabric take up roll relative to the revolving speed of the needle cylinder so that the speed of rotation of said take up roll may be coordinated with the speed of rotation of said take up roll may be coordinated with the speed of production of knit fabric by the knitting machine to maintain substantially uniform tension on the fabric being produced by the knitting machine.

2. In a knitting machine according to claim 1 wherein each of said adjustable diameter pulleys includes a plurality of radially disposed and positionally adjustable drive segments forming said radially adjustable driving surface, a pulley flange positioned on each side of said drive segments, and adjustment means operable in response to rotation of said pulley flanges relative to each other to vary the radial positions of said drive segments and to thereby vary the diameter of peripheral surface of said pulley in contact with said belt.

3. In a knitting machine according to claim 2 wherein said adjustment means includes radially extending guide grooves in one of said flanges, spiral grooves in the other of said flanges, guide means on one side of each of said drive segments and disposed in said radially extending guide grooves in said one flange,guide means on the other side of each of said drive segments and disposed in said spiral grooves in said other flange, and wherein said flanges are rotatable relative to each other to vary the radial positions of said drive segments to adjust the diameter of the peripheral surface of said pulley.

4. In a knitting machine according to claim 1 wherein an increase in fabric tension imparts pivotal movement to said pivoted support brackets to move said one drive pulley toward said other drive pulley and permit slipping of said driving belt so that tension of the fabric is reduced.

* * * * *

UNITED STATES PATENT AND TRADEMARK OFFICE

CERTIFICATE OF CORRECTION

PATENT NO. : 4,671,083

DATED : June 9, 1987

INVENTOR(S) : Masatoshi Sawazaki & Kouji Tsuchiya

It is certified that error appears in the above-identified patent and that said Letters Patent are hereby corrected as shown below:

Column 6, lines 62-64 (Claim 1), delete the following: "rotation of said take up roll may be coordinated with the speed of".

Signed and Sealed this

Twenty-ninth Day of September, 1987

*Attest:*

DONALD J. QUIGG

*Attesting Officer* *Commissioner of Patents and Trademarks*